US008008941B2

(12) United States Patent
Schmidt et al.

(10) Patent No.: US 8,008,941 B2
(45) **Date of Patent: *Aug. 30, 2011**

(54) POLISHING HEAD TESTING WITH MOVABLE PEDESTAL

(75) Inventors: Jeffrey P. Schmidt, San Jose, CA (US); Jay Rohde, Round Rock, TX (US); Stacy Meyer, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/829,971

(22) Filed: Jul. 2, 2010

(65) Prior Publication Data

US 2010/0327900 A1 Dec. 30, 2010

Related U.S. Application Data

(63) Continuation of application No. 11/686,868, filed on Mar. 15, 2007, now Pat. No. 7,750,657.

(51) Int. Cl.
*G01R 31/02* (2006.01)
*G01R 31/26* (2006.01)

(52) U.S. Cl. ..... 324/762.05; 324/750.3; 324/754.151; 324/756.01; 73/825; 451/5; 451/388

(58) Field of Classification Search ..... 324/754–765; 73/825; 451/5, 388
See application file for complete search history.

(56) References Cited

U.S. PATENT DOCUMENTS 5,035,087 A 7/1991 Nishiguchi et al.
5,313,156 A 5/1994 Klug et al.
5,342,068 A 8/1994 Large
5,486,129 A 1/1996 Sandhu et al.
5,539,676 A 7/1996 Yamaguchi
5,642,056 A 6/1997 Nakajima et al.
5,660,581 A 8/1997 Shin et al.
5,664,987 A 9/1997 Rentein (Continued)

FOREIGN PATENT DOCUMENTS

DE 3713155 11/1998

(Continued)

OTHER PUBLICATIONS

Applied Materials, "CMP Titan Head Test Fixture Manual," Rev. 004, Part No. 0251-01076, Section 2.3, Feb. 2001, pp. 14-17.

(Continued)

*Primary Examiner* — Huy Phan
*Assistant Examiner* — Emily Y Chan
(74) *Attorney, Agent, or Firm* — Fish & Richardson P.C.

(57) ABSTRACT

A polishing head is tested in a test station having a pedestal for supporting a test wafer and a controllable pedestal actuator to move a pedestal central wafer support surface and a test wafer toward the polishing head. In another aspect of the present description, the test wafer may be positioned using a positioner having a first plurality of test wafer engagement members positioned around the pedestal central wafer support surface. In another aspect, the wafer position may have a second plurality of test wafer engagement members positioned around an outer wafer support surface disposed around the pedestal central wafer support surface and adapted to support a test wafer. The second plurality of test wafer engagement members may be distributed about a second circumference of the ring member, the second circumference having a wider diameter than the first circumference. Additional embodiments and aspects are described and claimed.

15 Claims, 13 Drawing Sheets

U.S. PATENT DOCUMENTS

| | | | |
|---|---|---|---|
| 5,676,590 | A | 10/1997 | Hiraoka |
| 5,741,171 | A | 4/1998 | Sarfaty et al. |
| 5,759,918 | A | 6/1998 | Hoshizaki et al. |
| 5,804,983 | A | 9/1998 | Nakajima et al. |
| 5,828,223 | A | 10/1998 | Rabkin et al. |
| 5,828,225 | A | 10/1998 | Obikane et al. |
| 5,989,342 | A | 11/1999 | Ikeda et al. |
| 6,053,688 | A | 4/2000 | Cheng |
| 6,066,266 | A | 5/2000 | Osugi et al. |
| 6,113,480 | A | 9/2000 | Hu et al. |
| 6,135,698 | A | 10/2000 | Bonora et al. |
| 6,164,633 | A | 12/2000 | Mulligan et al. |
| 6,166,552 | A | 12/2000 | O'Connell |
| 6,220,936 | B1 | 4/2001 | Quek |
| 6,251,215 | B1 | 6/2001 | Zuniga et al. |
| 6,257,564 | B1 | 7/2001 | Avneri et al. |
| 6,259,247 | B1 | 7/2001 | Bannai |
| 6,272,902 | B1 | 8/2001 | Chen et al. |
| 6,361,422 | B1 | 3/2002 | Ettiger et al. |
| 6,379,221 | B1 | 4/2002 | Kennedy et al. |
| 6,402,595 | B1 | 6/2002 | Fiesser |
| 6,402,598 | B1 | 6/2002 | Ahn et al. |
| 6,428,389 | B2 | 8/2002 | Sato et al. |
| 6,459,945 | B1 | 10/2002 | Singh et al. |
| 6,501,289 | B1 | 12/2002 | Takekoshi |
| 6,522,125 | B2 | 2/2003 | Sagawa |
| 6,549,279 | B2 | 4/2003 | Adams et al. |
| 6,583,614 | B2 | 6/2003 | Takekoshi |
| 6,592,429 | B1 | 7/2003 | Campbell |
| 6,626,744 | B1 | 9/2003 | White et al. |
| 6,695,682 | B2 | 2/2004 | Sato et al. |
| 6,707,310 | B2 | 3/2004 | Takekoshi |
| 6,762,616 | B2 | 7/2004 | Kawaguchi et al. |
| 6,767,170 | B2 | 7/2004 | Kostler et al. |
| 6,794,889 | B2 | 9/2004 | Jafari et al. |
| 6,876,215 | B1 | 4/2005 | Hannan et al. |
| 6,894,480 | B2 | 5/2005 | Back |
| 6,933,736 | B2 | 8/2005 | Kobayashi et al. |
| 6,997,664 | B1 | 2/2006 | Liang et al. |
| 7,019,512 | B2 | 3/2006 | Martin et al. |
| 7,034,563 | B1 | 4/2006 | Souchkov et al. |
| 7,044,832 | B2 | 5/2006 | Yilmaz et al. |
| 7,089,782 | B2 | 8/2006 | Lin et al. |
| 7,750,657 | B2 * | 7/2010 | Schmidt et al. ..... 324/763 |
| 2001/0012751 | A1 | 8/2001 | Boyd et al. |
| 2002/0016131 | A1 | 2/2002 | Sandhu et al. |
| 2002/0024174 | A1 | 2/2002 | Gaal et al. |
| 2002/0137436 | A1 | 9/2002 | Kistler et al. |
| 2003/0134571 | A1 | 7/2003 | Cheng et al. |
| 2004/0051517 | A1 | 3/2004 | Holt et al. |
| 2004/0134287 | A1 | 7/2004 | Lin et al. |
| 2005/0176349 | A1 | 8/2005 | Yilmaz et al. |
| 2005/0227595 | A1 | 10/2005 | Marquardt et al. |
| 2005/0277323 | A1 | 12/2005 | Eldridge et al. |

FOREIGN PATENT DOCUMENTS

| | | |
|---|---|---|
| DE | 10123386 | 11/2002 |
| EP | 0747167 | 12/1996 |
| EP | 0879678 | 11/1998 |
| EP | 1018400 | 7/2000 |
| JP | 8094508 | 4/1996 |
| JP | 11067855 | 3/1999 |
| JP | 2001-298008 | 10/2001 |
| JP | 2001-310253 | 11/2001 |

OTHER PUBLICATIONS

EP Communication and Search Report dated Jul. 21, 2008 for Application No. 08152801.0-2302.

Office Action 1, Apr. 21, 2009, for Application No. EP08152801.0, 1 pg.

Office Action 2, Oct. 6, 2009, for Application No. EP08152801.0, 3 pp.

Office Action 1, Dec. 31, 2009, for Application No. KR10-2008-0023921, 3 pp.

Office Action 1, Dec. 31, 2009, for Application No. KR10-2008-0023921, 2 pp. [Translation].

PCT/US04/00328 Partial Search and Invitation to Pay Additional Fees, mailed Jun. 24, 2004.

PCT/US04/00328 International Search Report, mailed Sep. 6, 2004.

* cited by examiner

POLISHING HEAD TESTING WITH MOVABLE PEDESTAL

CLAIM OF PRIORITY

This application claims priority to and is a continuation of U.S. patent application Ser. No. 11/686,868, filed Mar. 15, 2007, which is incorporated by reference herein in its entirety.

BACKGROUND

Integrated circuits are typically formed on substrates, particularly silicon wafers, by the sequential deposition of conductive, semiconductive or insulative layers. After each layer is deposited, the deposited layer is often etched to create circuitry features. As a series of layers are sequentially deposited and etched, the outer or uppermost surface of the substrate, i.e., the exposed surface of the substrate, can become increasingly non-planar. This non-planar surface may present problems in the photolithographic steps of the integrated circuit fabrication process. Therefore, there is often a need to periodically planarize the substrate surface.

Chemical mechanical polishing (CMP) is one accepted method of planarization. This planarization method typically includes mounting a substrate on a carrier or polishing head using a load cup assembly. The exposed surface of the substrate is placed against a rotating polishing pad. The polishing pad may be either a "standard" or a fixed-abrasive pad. A standard polishing pad has a durable roughened surface, whereas a fixed-abrasive pad typically has abrasive particles held in a containment media. The polishing head provides a controllable load, i.e., pressure, on the substrate to push it against the polishing pad. A polishing slurry, including at least one chemically-reactive agent, and abrasive particles, if a standard pad is used, is supplied to the surface of the polishing pad.

The polishing head can undergo periodic maintenance in which the head is disassembled, worn parts replaced and then reassembled. Prior to returning the head to polishing additional wafers, the refurbished head can be tested at a test station to determine whether the head operates properly before using it on expensive wafers or other semiconductor substrates.

SUMMARY

In accordance with one aspect of the description provided herein, a polishing head is tested in a test station having a pedestal for supporting a test wafer and a controllable pedestal actuator to move a pedestal central wafer support surface and a test wafer toward the polishing head. The pedestal may be moved between a first vertical position vertically displaced from the polishing head, and a second vertical position vertically closer to the polishing head to facilitate polishing head testing.

In one embodiment, the testing includes testing a wafer loss sensor of the head. A wafer loss sensor test or other polishing head tests may include applying vacuum pressure to a membrane chamber of the head to pick up a first test wafer disposed on the pedestal central wafer support surface. The testing may also include applying pressure to an inner tube chamber of the head prior to applying the vacuum pressure to the membrane chamber and monitoring the pressure in the inner tube chamber while applying the vacuum pressure to the membrane chamber.

In another aspect of the present description, the test wafer may be positioned using a positioner having a first plurality of test wafer engagement members positioned around the pedestal central wafer support surface. The test wafer engagement members engage the test wafer to position the test wafer with respect to the pedestal central wafer support surface. In one embodiment, the wafer positioner comprises a ring member adapted to carry the first plurality of test wafer engagement members distributed about a first circumference of the ring member.

In yet another aspect, polishing head testing may include positioning a test wafer having a second diameter wider than the first diameter using a positioner having a second plurality of test wafer engagement members positioned around an outer wafer support surface disposed around the pedestal central wafer support surface and adapted to support a test wafer. The second plurality of test wafer engagement members may be distributed about a second circumference of the ring member, the second circumference having a wider diameter than the first circumference.

In still another aspect, the test station may have a removable cover plate having its own wafer support surface. The cover plate may be removed to expose the pedestal and test wafer positioner.

There are additional aspects to the present inventions. It should therefore be understood that the preceding is merely a brief summary of some embodiments and aspects of the present inventions. Additional embodiments and aspects are described and claimed. The preceding summary therefore is not meant to limit the scope of this description.

DETAILED DESCRIPTION

Figure 1:
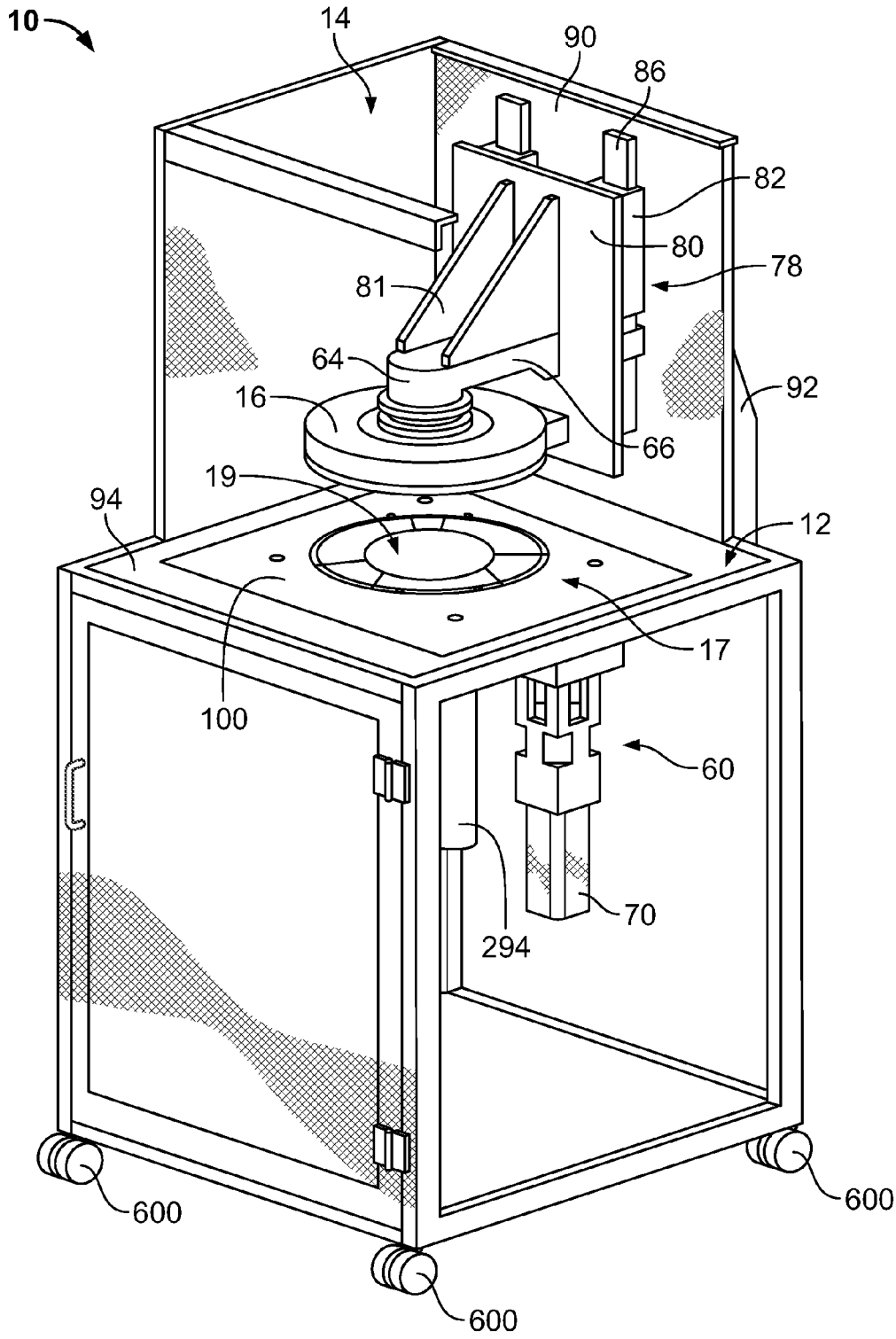
FIG. 1 is a perspective view of a polishing head test station having a test wafer hold and transfer system in accordance with one embodiment of the present description, with a cover plate removed.

A test station in accordance with one embodiment of the present invention is indicated generally at 10 in FIG. 1. The test station 10 includes a frame or platform 12 which supports a head positioning control system 14 which positions a chemical and mechanical polishing head 16 above the platform 12. As described in greater detail in U.S. Pat. No. 7,089,782, the head position control system 14 can precisely position the head 16 at one of many electronically controlled positions above the platform 12 to facilitate various testing procedures of the head 16. It is appreciated however that the polishing head 16 may be mounted at a fixed height or manually movable between different heights, or actuated using other mechanisms, depending upon the particular application.

In accordance with one aspect of the present description, the test station 10 further includes a test wafer hold and transfer system 17 which includes a movable pedestal 19. As described in greater detail below, the test wafer hold and transfer system 17 positions a test wafer relative to the polishing head 16 to facilitate testing of the polishing head 16. For example, the test wafer hold and transfer system 17 can provide for simulation of the loading of a wafer by the load cup assembly of a CMP tool.

Figure 2:
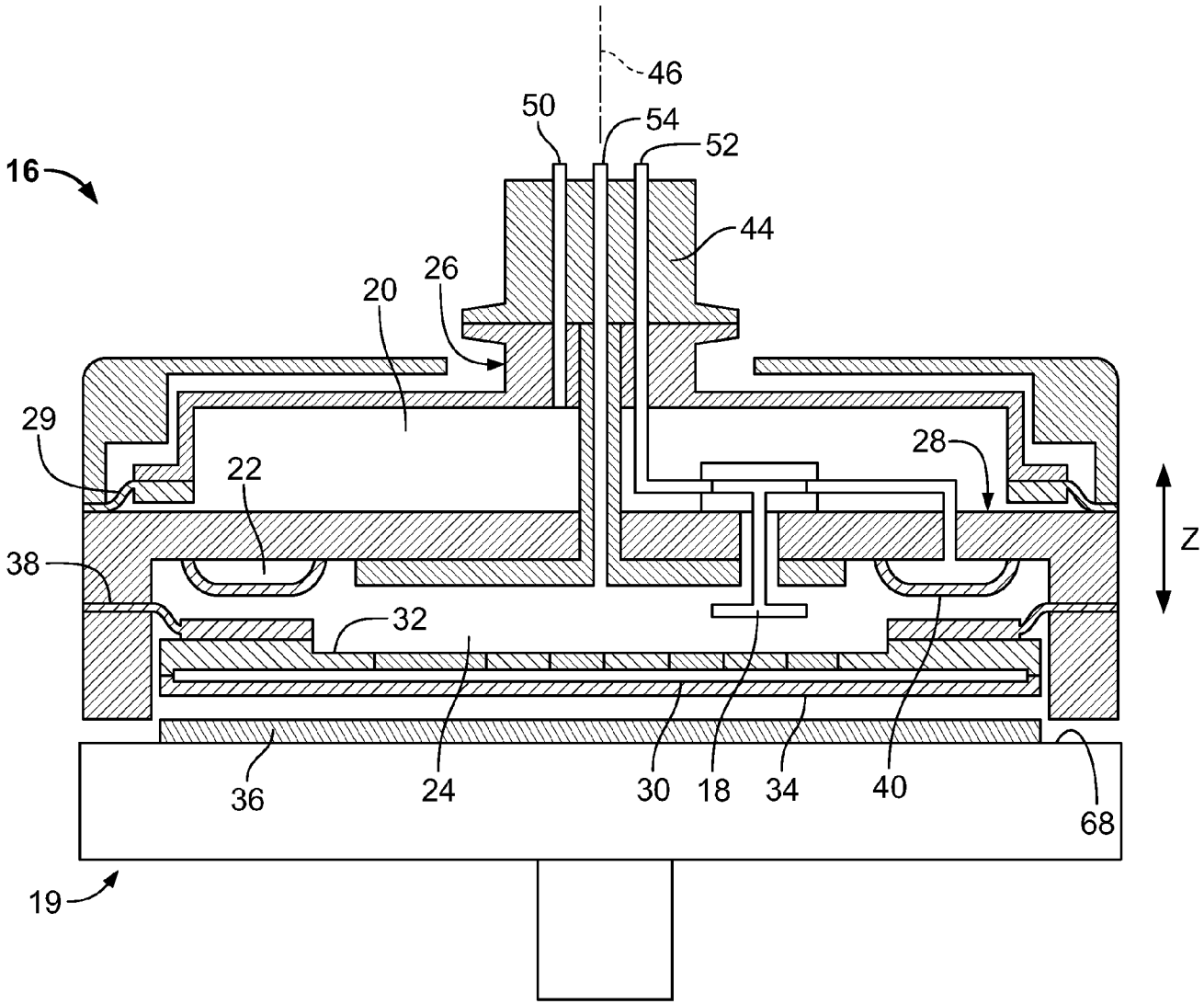
FIG. 2 is a schematic cross-sectional view of a typical polishing head disposed over a pedestal of one embodiment of a test wafer hold and transfer system.

FIG. 2 shows a schematic cross-sectional diagram of a typical chemical and mechanical polishing head 16 positioned over the movable pedestal 19 of the test wafer hold and transfer system 17. It should be appreciated that a test station in accordance with aspects of the present description may be used to test a variety of different types of wafer or substrate polishing heads including heads for polishing 150 mm, 200 mm or 300 mm wafers.

As described in greater detail in U.S. Pat. No. 7,089,782, a polishing head such as the head 16 of FIG. 2 may have several sensors which are preferably tested by the test station 10. An example of such a sensor is indicated generally at 18 and senses if the wafer has been lost. The number and type of sensors may vary from one type of polishing head to another. Other common types of head sensors include wafer presence sensors and wafer pressure sensors.

The polishing head 16 also has three pressure sealed chambers, that is, a retaining ring chamber 20, an inner tube chamber 22 and a membrane chamber 24. The test station 10 can apply various tests to the chambers to ensure proper sealing and operation. It is appreciated that the number and types of chambers may vary from head type to head type. For example, the head may have from three to eight chambers.

In the head 16 of the illustrated embodiment, the retaining ring chamber 20 is located between a housing 26 and a base 28 of the head 16. The retaining ring chamber 20 is pressurized to apply a load, i.e., a downward pressure, to the base 28 during a wafer polishing operation. A rolling diaphragm 29 flexibly couples the housing to the base 28 and permits the expansion and contraction of the retaining ring chamber 20. In this manner, the vertical position of the base 28 relative to a polishing pad is controlled by the pressure in the retaining ring chamber 20.

A flexible membrane 30 extends below a support structure 32 to provide a mounting surface 34 for the wafer or other semiconductor substrate 36 to be polished. Pressurization of the membrane chamber 24 positioned between the base 28 and support structure 32 forces flexible membrane 30 downwardly to press the substrate against the polishing pad. A flexure 38 flexibly couples the support structure 32 to the base 28 and permits the expansion and contraction of the membrane chamber 24.

Another elastic and flexible membrane 40 may be attached to a lower surface of base 28 by a clamp ring or other suitable fastener to define the inner tube chamber 22. Pressurized fluid such as air may be directed into or out of the inner tube chamber 22 and thereby control a downward pressure on support structure 32 and flexible membrane 30.

The housing 26 is connected to a spindle 44 of the polishing system used to rotate the head 16 therewith during polishing about an axis of rotation 46 which is substantially perpendicular to the surface of the polishing pad during polishing. Three pressure lines 50, 52 and 54 direct fluid such as air or nitrogen to each of the chambers 20,22 and 24 either at a pressure above ambient (pressurized) or below ambient (vacuum pressure).

As shown in FIG. 1, the head position control system 14 of the head test station includes an electronically controlled linear actuator 60 which is controlled by a controller 62 (FIG. 9) which may be a programmed general purpose computer such as a personal computer. Alternatively, the controller 62 may comprise programmed logic arrays, distributed logic circuits or other digital or analog control circuitry. The linear actuator 60 can position a head 16 mounted in a mount 64 at one end of a mount arm 66, at a precise position selected by the controller 62. In the illustrated embodiment, the controlled precise position is the vertical displacement of the head 16 relative to a test surface or test wafer support surface 68 (FIG. 2) of the of the pedestal 19 of the test station 10. This vertical displacement is measured along a Z-axis which is orthogonal to the test surface 68 which supports a test wafer for testing with the polishing head. In this embodiment, the Z-axis is parallel to the axis 46 of rotation of the head. It is appreciated that other displacement directions may be selected for control.

The head mount actuator 60 includes a servo motor assembly 70 which is controlled by the controller 62 through suitable driver circuits. It is appreciated that other types of motors may be used to actuate the polishing head to various vertical positions, depending upon the particular application.

The output of the servo motor assembly 70 is coupled to a vertical carriage assembly 78 which guides the mount arm 66 and restricts the movement of the mount arm and hence the head 16 to linear, nonrotational movements along the Z-axis. The carriage assembly 78 includes a carriage 80 to which the mount arm 66 is mounted by a pair of braces 81. The carriage 80 has a pair of guide bars 82 which are adapted to slide along guide rails 86 mounted on a vertical support plate 90 to guide the carriage 80 and hence the head 16 in a vertical, non-pivoting, linear movement up and down along the Z-axis. The support plate 90 is mounted by braces 92 to a horizontal support plate 94 of the platform 12. It is appreciated that other mechanical arrangements may be selected to guide the polishing head along one or more selected axes of movement.

Figure 3:
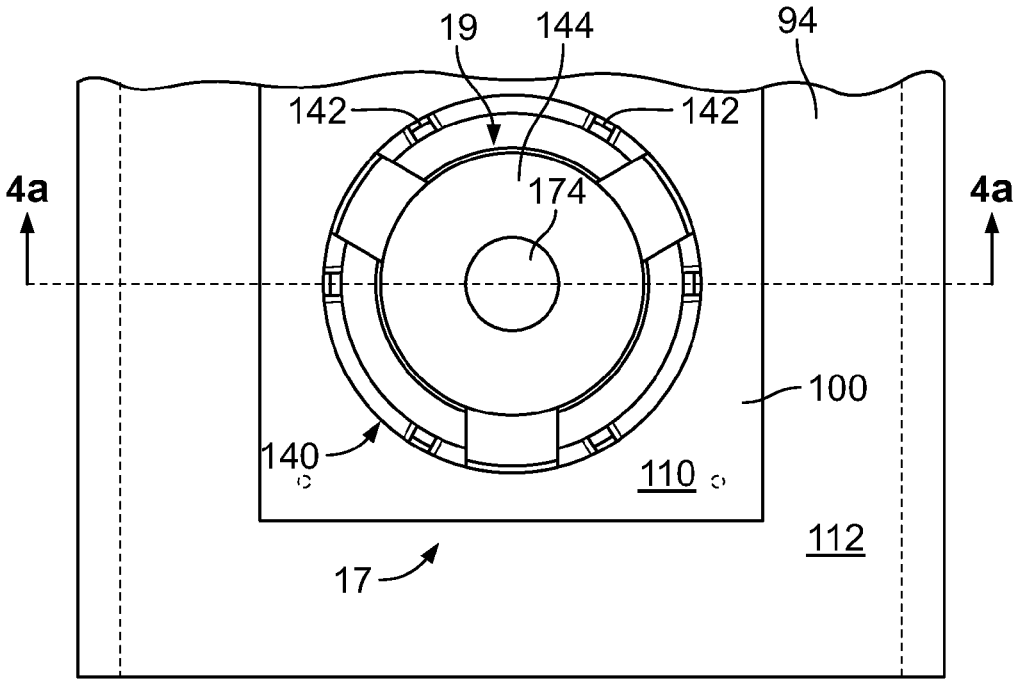
FIG. 3 is a top view of the test wafer hold and transfer system of the test station of FIG. 1, shown with a cover plate removed.
Figure 4A:
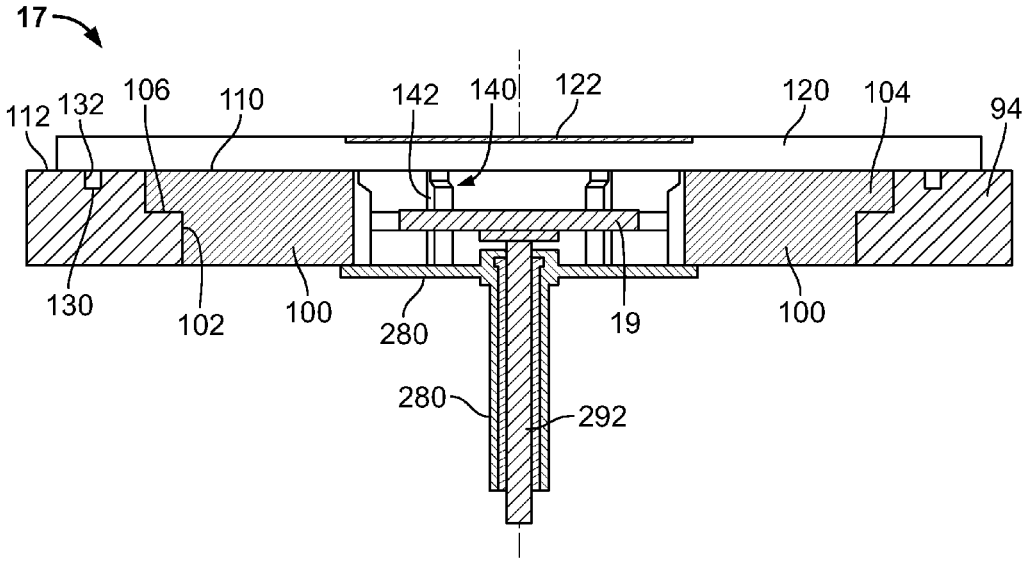
FIG. 4*a* is a schematic partial side cross-sectional view of the test wafer hold and transfer system shown with a cover plate.
Figure 4B:
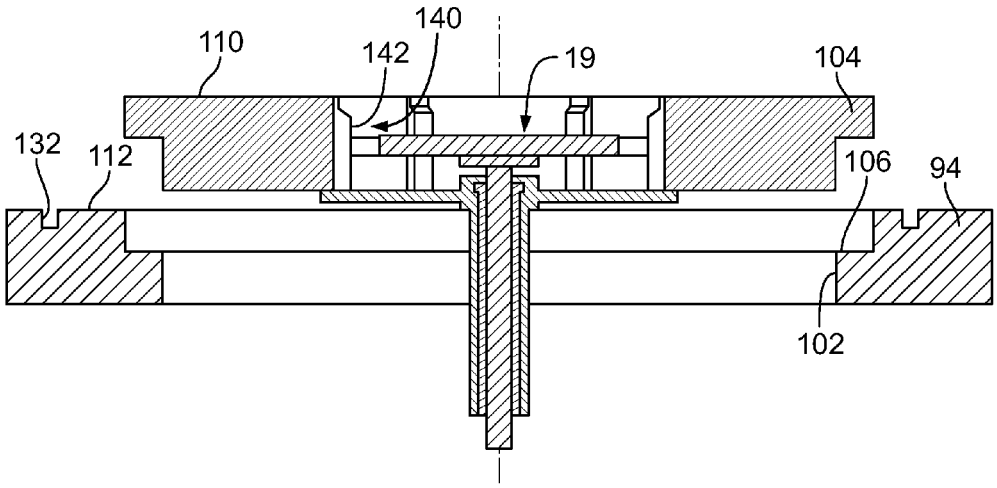
FIG. 4*b* is an exploded schematic partial side cross-sectional view of the test wafer hold and transfer system shown without a cover plate.

FIG. 3 shows a top schematic view of one embodiment of the test wafer hold and transfer system 17. A partial cross-sectional schematic view of the test wafer hold and transfer system 17 of FIG. 3 as viewed along the lines 4*a*-4*a* of FIG. 3 is shown in FIG. 4*a*. The test wafer hold and transfer system 17 includes a support plate 100 which is received in a cavity 102 (best seen in FIG. 4*b*) defined by the support 25 plate 94 of the frame or platform 12. The support plate 100 has a flange 104 which is received by a shoulder 106 of the support plate cavity 102. In this manner, the support plate 100 of the test wafer hold and transfer system 17 is supported by the support plate 94 of the frame 12.

In accordance with another aspect of the present description, the cavity 102 of the support plate 94 of the frame 12, is sized and shaped so as to permit the top surface 110 of the support plate 100 to be flush with or recessed with respect to the top surface 112 of the support plate 94. Such an arrangement can facilitate placement of an optional cover plate 120 on the support plate 94 to cover the test wafer hold and transfer system 17. In some prior systems, a cover plate similar to the plate 120 is often used to provide a test wafer support surface similar to the surface 122 for polishing head testing purposes.

Accordingly, in the illustrated embodiment of FIG. 4*a*, a polishing head such as the polishing head 16 may be tested using the test wafer support surface 122 of the cover plate 120. Alternatively, the cover plate 120 may be removed to expose the test wafer hold and transfer system 17 to facilitate additional testing of a polishing head using the test wafer hold and transfer system 17 instead of the cover plate 120. The cover plate 120 may be precisely positioned on the support plate 94 of the frame 12 using registration pins 130 of the cover plate 120 received in corresponding registration holes or apertures 132 (FIG. 4*b*) of the support plate 94. It is appreciated that other mechanisms and devices may be used to position the removable cover plate 120, depending upon the particular application.

Figure 5:
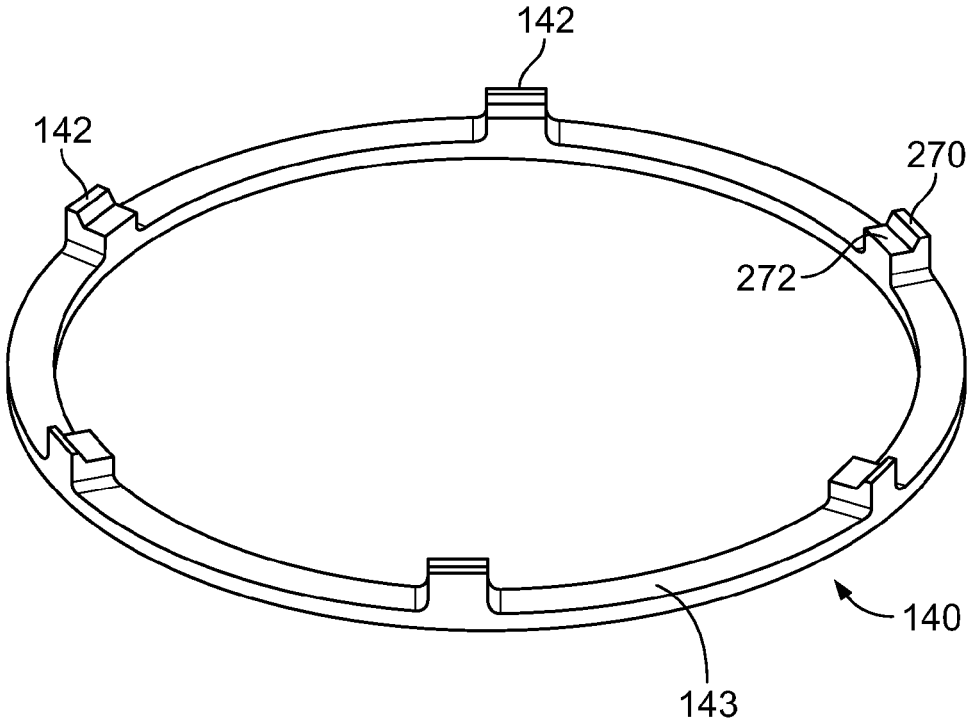
FIG. 5 is a perspective view of a wafer positioner of the test wafer hold and transfer system of FIG. 1.
Figure 6A:
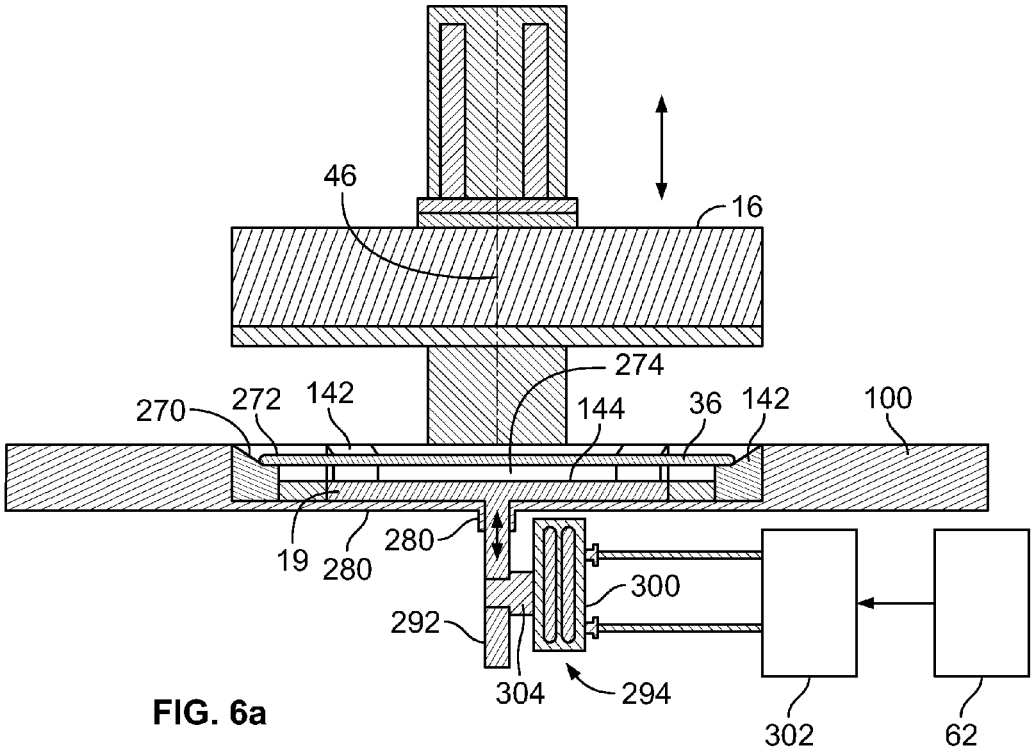
FIGS. 6*a*-6*g* illustrate one example of operations of the test wafer hold and transfer system to test a polishing head.

The test wafer hold and transfer system 17 further includes a test wafer positioner 140 which has a plurality of test wafer engagement members 142 carried by a ring member 143 (FIG. 5) and distributed about the circumference of the ring member 143. As best seen in FIG. 3, the test wafer engagement members 142 of the wafer positioner 140 are positioned around a central wafer support surface 144 (FIG. 3) of the pedestal 19. The test wafer engagement members 142 are adapted to engage and position a test wafer 36 (FIG. 6*a*) with respect to the pedestal central wafer support surface 144 prior to the pedestal 19 receiving the test wafer 36 and transporting the test wafer 36 up to the polishing head 16.

Figure 7A:
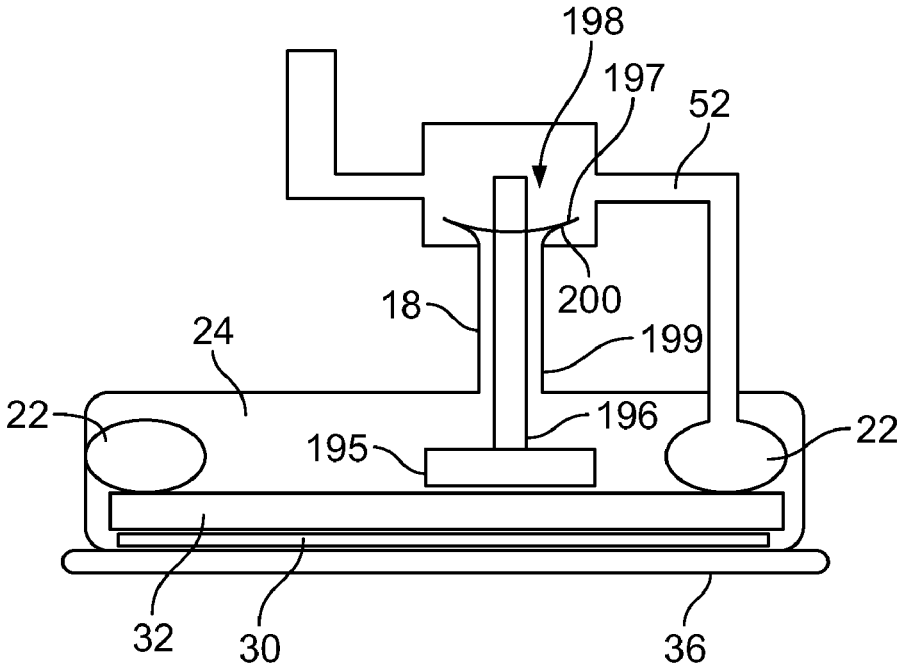
FIGS. 7*a* and 7*b* are schematic diagrams illustrating operation of a wafer loss sensor of the polishing head of FIG. 2.
Figure 7B:
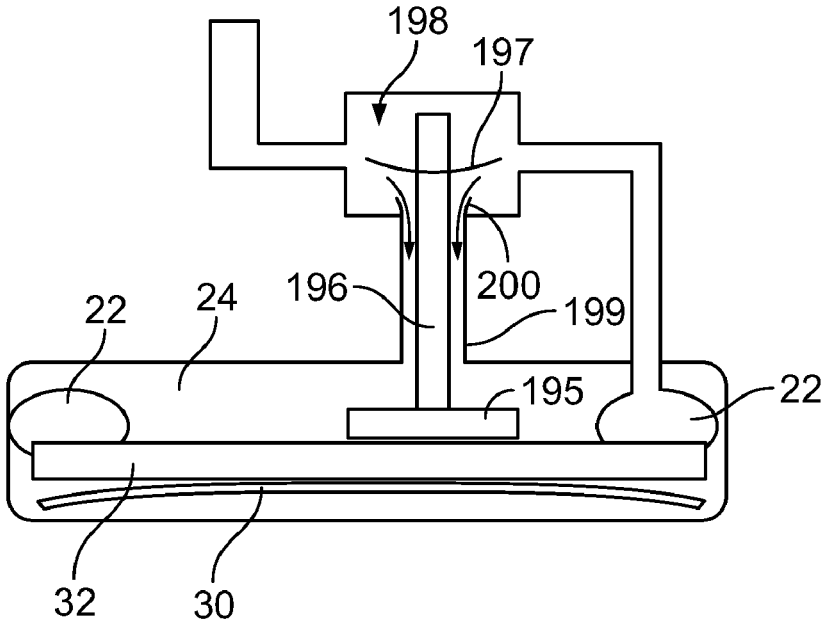

As previously mentioned, the test station 10 may be used to test a variety of sensors, chambers and other structures of a polishing head. FIGS. 7*a* and 7*b* illustrate in schematic form the operation of a typical "wafer loss" sensor 18 which provides an indication that the head is not holding a wafer. As shown in FIG. 7*a*, the wafer loss sensor 18 includes a sensor disk 195 which is connected by a shaft 196 to a valve member 197 of a valve 198. The shaft 196 moves in a conduit 199 which connects the membrane chamber 24 to the pressure line 52 of the innertube chamber 22. When a wafer 36 is held by the head 16, the wafer 36 seals the ambient pressure away from the membrane 30. In addition, the support structure 32 is displaced from the wafer loss sensor disk 195. If the inner tube chamber 22 is pressurized at a pressure of 1 psi (pounds per square inch) above ambient, for example, and the membrane chamber is at a vacuum pressure of −5 psi below ambient, for example, the valve member 197 attached to the sensor shaft 196 is sealingly seated in a valve seat 200 of the conduit 52. Consequently, the valve 198 is sealed closed and the pressures of the membrane chamber 24 and the inner tube chamber 22 remain constant, indicating that the wafer has not been "lost."

However, should the wafer drop from the head 16, ambient pressure acting on the membrane 30 drives the membrane 30 and the support structure upwardly into the membrane chamber as shown in FIG. 7*b*. The support structure 32 engages and compresses the inner tube chamber 22 causing the pressure in the inner tube chamber 22 to begin to rise as indicated at 202 in FIG. 8. As the membrane 30 and the support structure continue upwardly into the membrane chamber 24, the support structure also engages the disk 195 of the wafer loss sensor 18 as shown in FIG. 7*b*. This engagement causes the valve member 197 connected to shaft 196 of the sensor 18 to displace from the valve seat 200. As a consequence, the valve opens as indicated at 203 and the pressure in the inner tube chamber 22 begins to fall as indicated at 204 in FIG. 8 and eventually equalizes with the membrane chamber 20, indicating loss of the wafer.

Figure 9:
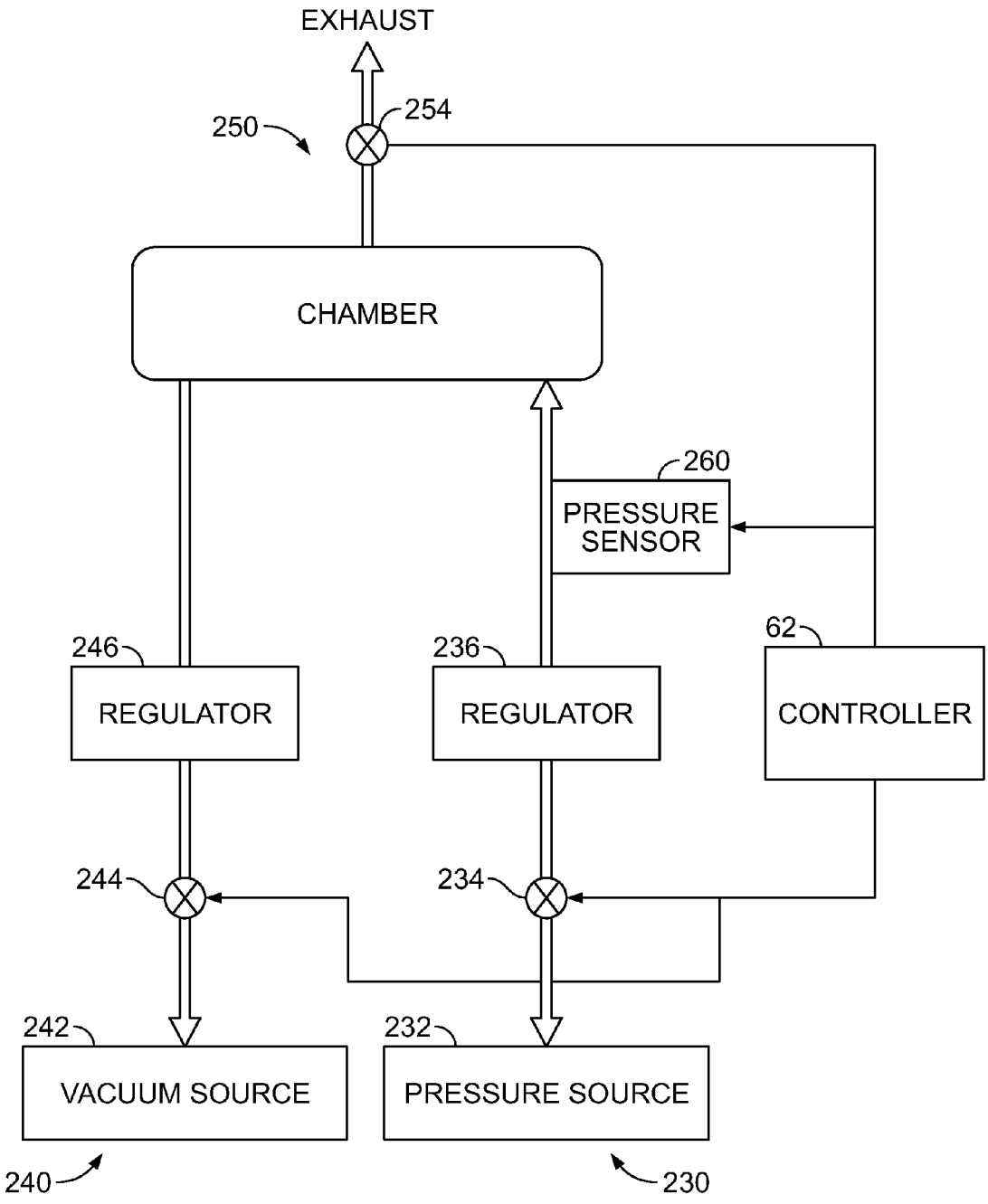
FIG. 9 is a schematic diagram of one example of test station pneumatic circuits associated with each pressure chamber of the polishing head of FIG. 2.

FIG. 9 is a schematic diagram of the pneumatic circuits associated with each chamber of the polishing head. In the illustrated embodiment, each chamber has a pressure circuit 230 which includes a source 232 of pressurized fluid coupled by a valve 234 and a regulator 236 to the chamber. Each chamber further has a vacuum circuit 240 which includes a source 242 of vacuum pressure (often referred to a vacuum ejector valve) coupled by a valve 244 and a regulator 246 to the chamber. A vent circuit 250 includes a valve 254 and opens the associated chamber to the ambient atmosphere.

The valves 234, 244 and 254 are controlled by the controller 62. To conserve pressure in a particular chamber, the vent valve 254, pressure valve 234 and vacuum valve 254 are closed. By closing these valves, the chamber is isolated from being further pressurized, vacuumed or vented. The pressure within the chamber may be monitored by the controller 62 through a pressure sensor 260 such as a transducer fluidically coupled to the associated chamber. If the chamber pressure drops after closing the control valves 234, 244 and 254, the presence of a leak is indicated. As previously mentioned, if the pressure in the inner tube chamber 22 follows a curve such as that shown in FIG. 8, a loss of a test wafer which had been held by the polishing head is indicated.

The test station 10 can test the chambers of the polishing head for pressure and vacuum leaks including leaks across the various chambers (cross talk). Testing includes height and time of rise as well as valve and sensor tests.

Figure 10:
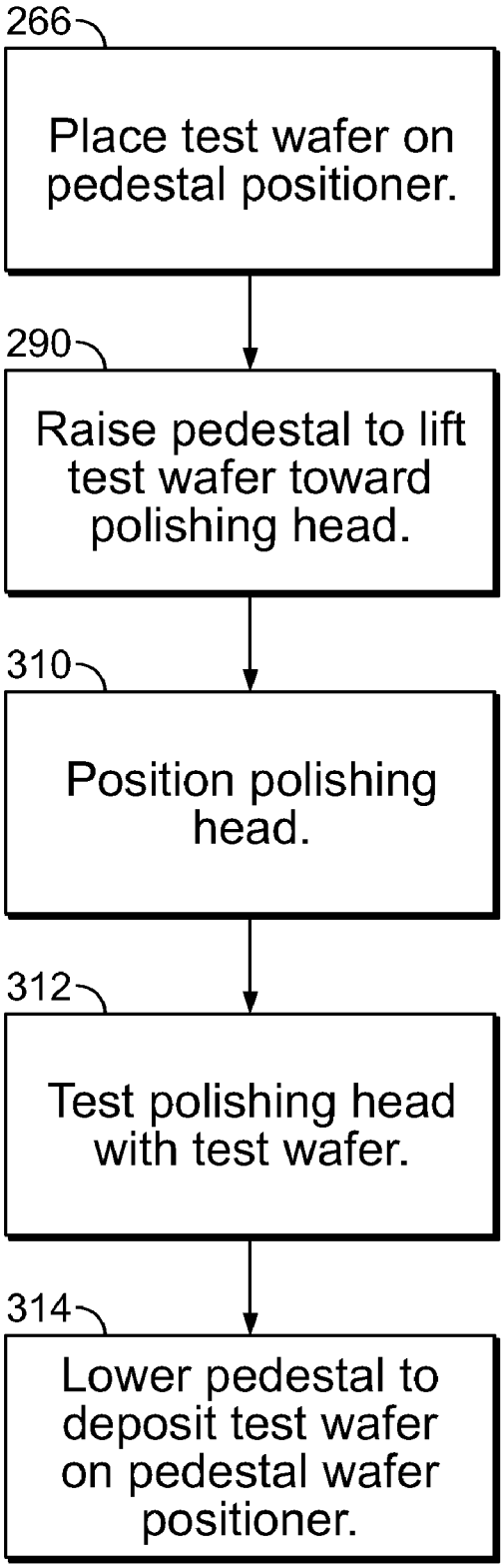
FIG. 10 is a flow chart illustrating one example of operations of the test wafer hold and transfer system to test a polishing head.

FIG. 10 illustrates a polishing head test utilizing a test station in accordance with one embodiment of the present description. One example of such a test is a wafer loss sensor test. It is appreciated that a test station in accordance with the present description may be used to perform a variety of tests, depending upon the particular application.

In a first operation, the test wafer is placed (block 266) on a wafer positioner such as the wafer positioner 140. In the illustrated embodiment, the test wafer engagement members 142 of the wafer positioner 140 are generally finger-shaped and each includes an angled ramp surface 270 (FIG. 6*a*) which engages the edge of the test wafer 36 and directs the test wafer to settle under the influence of gravity in an aligned position between the ramp surfaces 270 and supported by a generally horizontal support surface 272 of each test wafer engagement member 142. In this aligned position, the center 274 of the central wafer support surface 144 of the pedestal 19 is substantially coaxially aligned with the center of the test wafer 36. Also, in the illustrated embodiment, the center axis 46 (FIG. 2) of the polishing head 16 is substantially aligned with the center of the testing wafer. Such an alignment can facilitate testing of the polishing head 16. It is appreciated that the wafer positioner may be designed to achieve other alignments between the testing wafer and the pedestal 19 or the polishing head 16. It is further appreciated that the test wafer engagement members 142 may have a variety of different shapes and engagement surfaces, depending upon the particular application.

In the illustrated embodiment, the pedestal 19 and the test wafer positioner 140 are supported by a pedestal housing 280 affixed to the support plate 100 of the test wafer hold and transfer system 17. The pedestal 19 and test wafer positioner 140 are supported in the test station 10 such that the centers of the pedestal 19 and test wafer positioner 140 are coaxially aligned with the center axis 46 (FIG. 2) of the polishing head 16. It is appreciated that other alignments may be selected, depending upon the particular application.

Figure 6B:
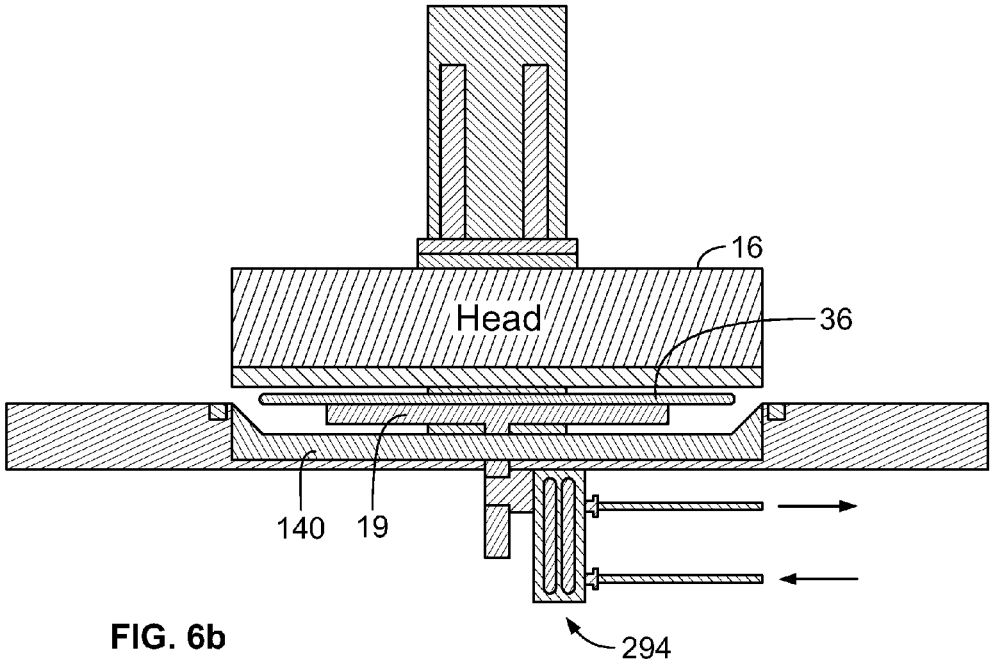

Once the test wafer has been positioned by the wafer positioner 140, the pedestal may be raised (block 290) causing the pedestal support surface 144 of the pedestal 19 to engage the underside of the test wafer. Continued upward motion of the pedestal 19 lifts the test wafer off the wafer positioner 140 and moves the test wafer vertically upward toward the polishing head 16 as shown in FIG. 6*b*, for example. In this position, the center of the test wafer continues to be coaxially aligned with the center of the polishing head 16.

In the illustrated embodiment, the pedestal 19 has a central connecting rod 292 which is journaled for a sliding, vertical motion within the pedestal housing 280. A pedestal actuator 294 coupled to the pedestal connecting rod 292 vertically actuates the pedestal 19 between a first, lowered position depicted in FIG. 6*a*, and a second, raised position, depicted in FIG. 6*b*. It is appreciated that the pedestal 19 may have other shapes and members to facilitate vertical movement.

In the illustrated embodiment, the pedestal actuator 294 includes a pneumatic cylinder 300 which is driven by pneumatic circuits 302 controlled by the test station controller 62. The pneumatic cylinder 300 is connected by a drive member 304 to the connecting rod of the pedestal 19. Upon application of suitable pneumatic pressures to the pneumatic cylinder 300, the drive member 304 and hence the pedestal 19 are selectively driven in upward or downward movements. The range of the vertical motion may be limited by suitable stops or by the controller 62, depending upon the particular application. It is appreciated that other types of actuators may be used to elevate the pedestal 19. Such other actuators includes electric motors and servos.

Figure 6C:
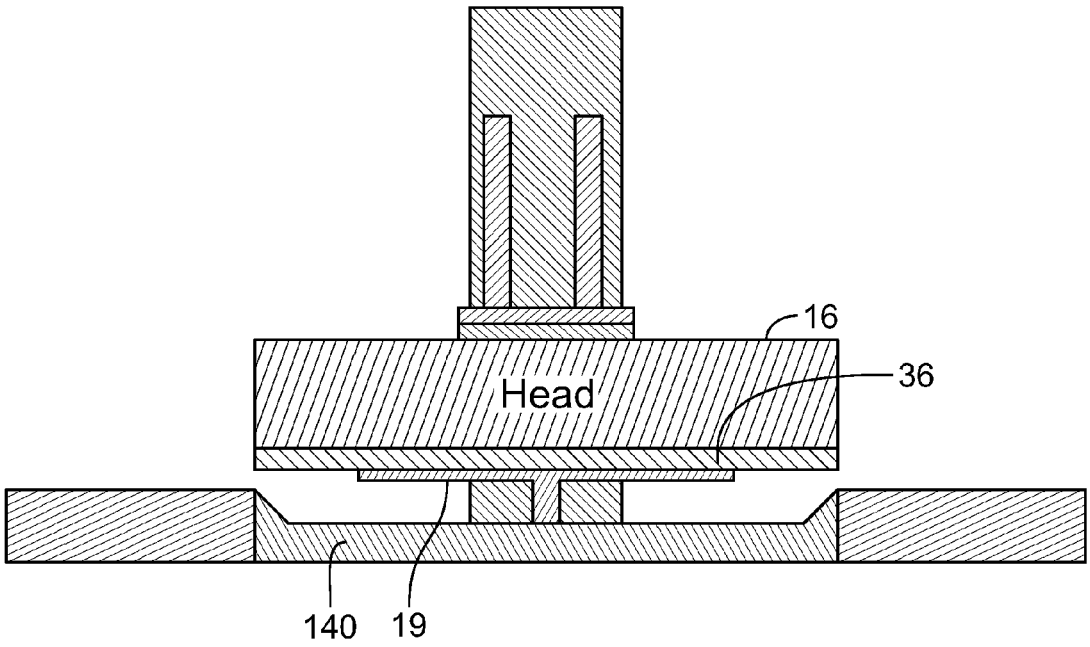

Prior to initiating a test of the polishing head 16, the controller 62 can control the linear actuator 60 (FIG. 1) to position (block 310) the head 16 at a selected height above the pedestal 16 and the test wafer 36 as shown in FIG. 6*c*. The selected height may vary, depending upon the particular test to be performed. It is appreciated that for some polishing head tests, positioning of the polishing head 16 may be omitted. Once the polishing head 16 is at the appropriate height above the pedestal 16, a test of the polishing head may be initiated (block 312).

For example, in a wafer loss sensor test, the polishing head may be displaced above the top surface of the test wafer prior to loading the test wafer by a distance such as 1.5 mm, for example. At this height, the controller 62 can cause the head 16 to begin the process of loading the test wafer onto the polishing head. The membrane chamber 24 (FIG. 2) may be pressurized to cause the head membrane 30 to become inflated prior to actually loading the wafer. As the head membrane 30 inflates, it engages the top surface of the test wafer and expresses away air pockets which may otherwise become trapped between the membrane 30 and the wafer top surface.

To load the test wafer, the inner tube chamber 24 is also pressurized to apply pressure to push the perimeter of the membrane 30 against the perimeter of the test wafer. The pressure in the inner tube chamber is then conserved at that pressure to test for leaks in the inner tube chamber as set forth above. If the pressure in the inner tube chamber remains steady at the preset pressurized level, a proper sealing of the inner tube chamber is indicated. In the illustrated embodiment, it is preferred that the inner tube chamber be pressurized to a level of 1 psi above ambient for the wafer loss sensor test. Other pressures in a range of 0-3 psi may also be used. The particular values will vary, depending upon the particular application.

Figure 6D:
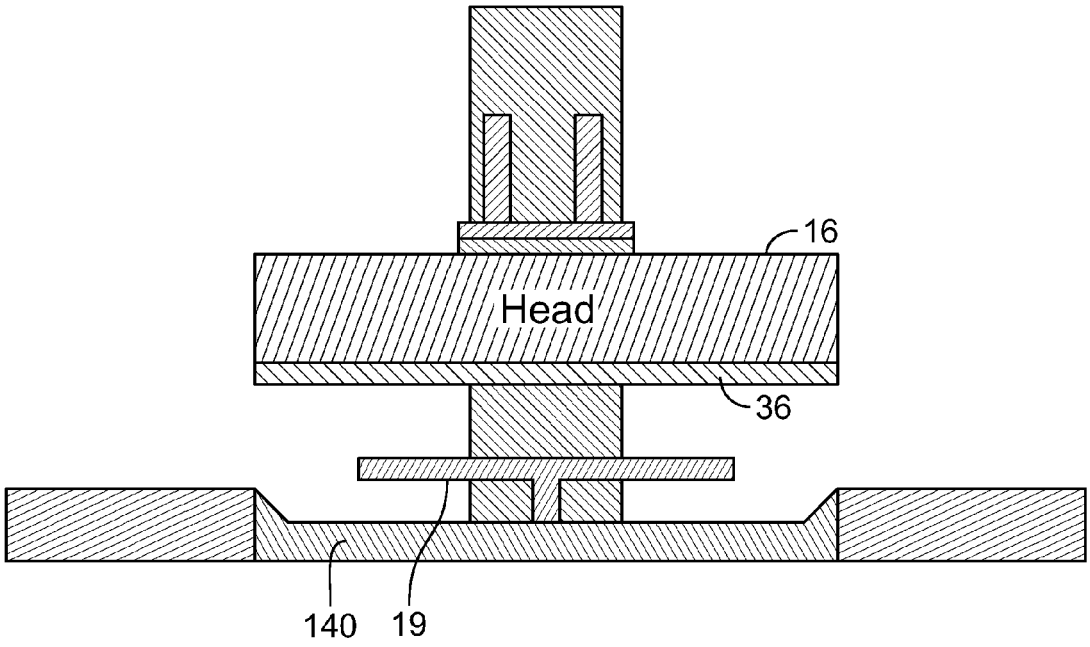

Once maintenance of the pressure in the inner tube chamber 22 has been confirmed at the preset value, and air pockets between the membrane 30 and the wafer top surface expressed away, a vacuum pressure is applied to the membrane chamber 24 to finish loading the test wafer. The polishing head with the loaded test 15 wafer may then be withdrawn from the pedestal 19 to another height above the pedestal 19 as shown in FIG. 6*d*. In the illustrated embodiment, it is preferred that the membrane chamber be vacuum pressurized to a level of −5 psi below ambient for the wafer loss sensor test. Other pressures in a range of −2 to −7 psi below ambient may also be used. The particular values will vary, depending upon the particular application.

Figure 8:
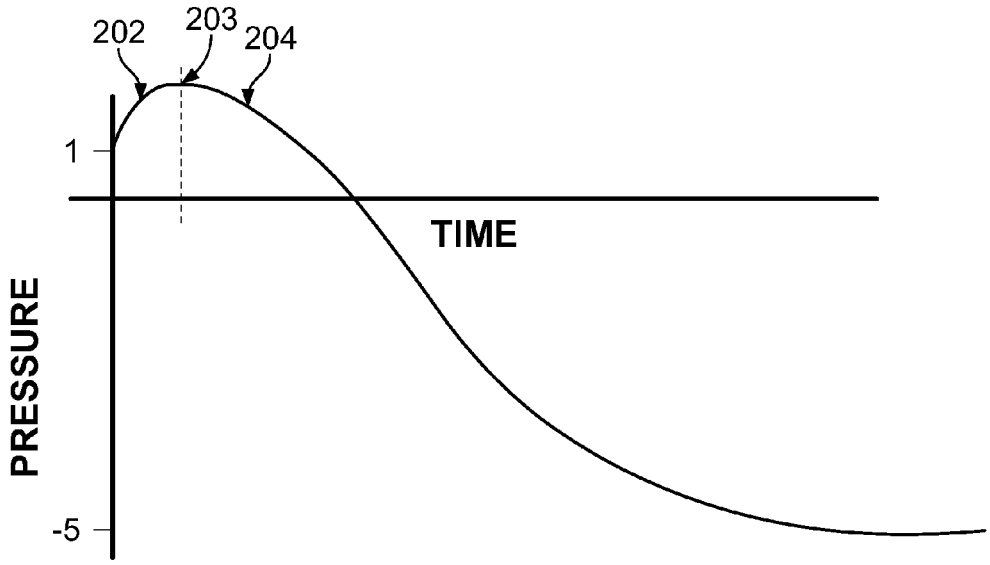
FIG. 8 is a graph illustrating pressure changes in the inner tube chamber of the polishing head during operation of the wafer loss sensor as indicated in FIGS. 7*a* and 7*b*.

If the wafer is properly loaded in a manner similar to that shown in FIG. 7*a*, and the wafer loss sensor has been properly installed and operates properly, the wafer loss sensor will not be actuated and the pressure in the inner tube chamber 22 should remain substantially constant as monitored by the controller 62. On the other hand, if the wafer is not properly picked up or is dropped, the membrane 30 will be drawn into the membrane chamber 24 causing the support structure 32 to engage the inner tube chamber and the wafer loss sensor 18 as shown in FIG. 7*b*. Consequently, the pressure in the inner tube chamber 22 will initially rise as the support structure engages the inner tube chamber 22 as shown in FIG. 8 and then the pressure in the inner tube chamber will fall as the wafer loss sensor opens the valve 86 between the inner tube chamber 22 and the membrane chamber 24, indicating to the controller 62 that the wafer has been lost.

In the illustrated embodiment, it is preferred for the head test station 10 to be able to precisely position the polishing head at a precise, electronically controlled position to facilitate testing of the polishing head as described in U.S. Pat. No. 7,089,782. For example, in the wafer loss sensor test with a test wafer as described above, if the polishing head is positioned too close to the test wafer prior to loading the wafer, it is believed that the membrane 30 and support structure 32 can be driven up into the membrane chamber 24, causing the wafer loss sensor 18 to be improperly actuated. Conversely, if the polishing head is positioned too far from the test wafer prior to loading the wafer, the test wafer may not be properly picked up. Hence, vacuum pressure applied to the membrane chamber 24 to pick up the wafer can instead cause the membrane 30 and support structure 32 to be withdrawn into the membrane chamber 24, again resulting in improper actuation of the wafer loss sensor 18. A vertical position of the polishing head spaced within a range of 1-2 mm above the test surface is believed appropriate for many such applications. Other distances may also be used. The particular values will vary, depending upon the particular application.

Because of the many positions to which the head may be programmed to move, the head test station in effect provides continuous control over the movement of the head relative to the raised pedestal 19. The test position and load position of the head may be defined relative to the raised pedestal 19 for many different types of heads. Any differences in the size of the heads including differences in thickness may be readily accommodated by programming the actuator control to move the head to the optimum positions for that particular head type.

Figure 6E:
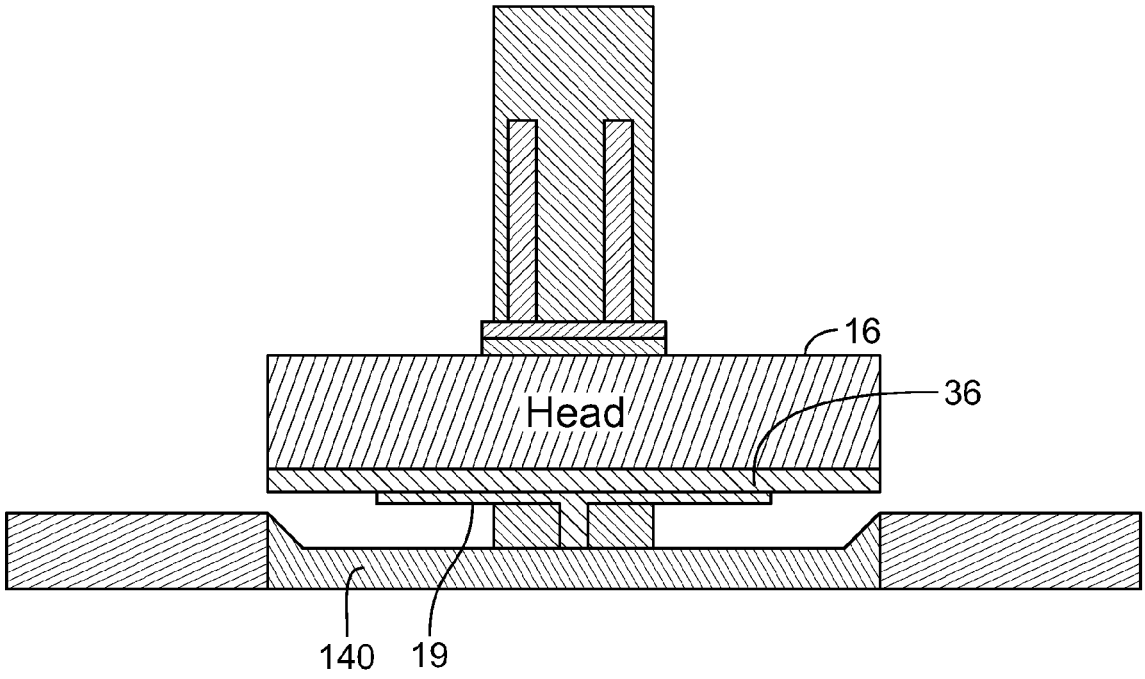
Figure 6F:
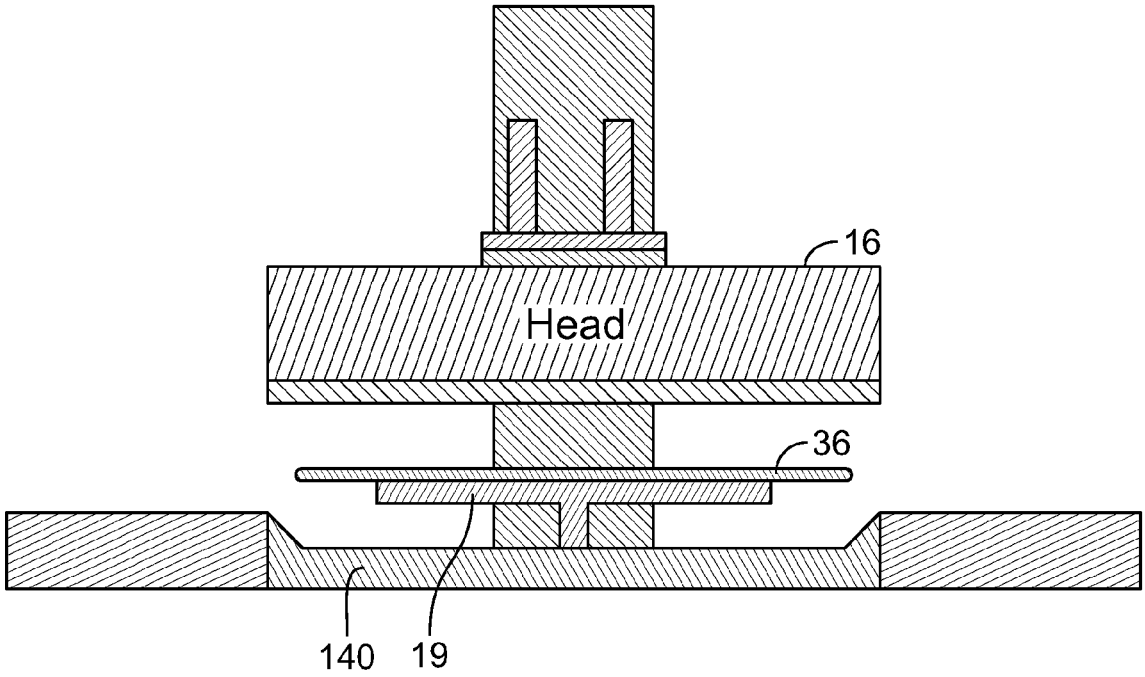

Upon conclusion of testing of the polishing head 16 using a test wafer, or as part of testing, the polishing head 16 can return the test wafer to the pedestal 19. Accordingly, the controller 62 controls the linear actuator 60 to position the polishing head 16 to a vertical position adjacent the pedestal 19 as shown in FIG. 6*e*. The pneumatic circuits of the polishing head 16 may further be controlled by the controller 62 to cause the polishing head 16 to release the testing wafer and deposit the testing wafer on the pedestal 19 as shown in FIG. 6*f*. In addition, the controller 62 can withdraw the polishing head to another height as shown in FIG. 6*f*.

Once the test wafer has been returned to the pedestal 19 by the polishing head 60, the pedestal 19 may be lowered (block 314) to the wafer positioner 140. Continued downward motion of the pedestal 19 deposits the test wafer on the wafer positioner 140 and realigns the center of test wafer with respect to the center of the polishing head 16 as appropriate. Testing may then be concluded or additional testing of the polishing head may then be performed as appropriate. Such additional testing may include or exclude use of a test wafer 36 or movement of the pedestal 19, depending upon the particular application.

Figure 6G:
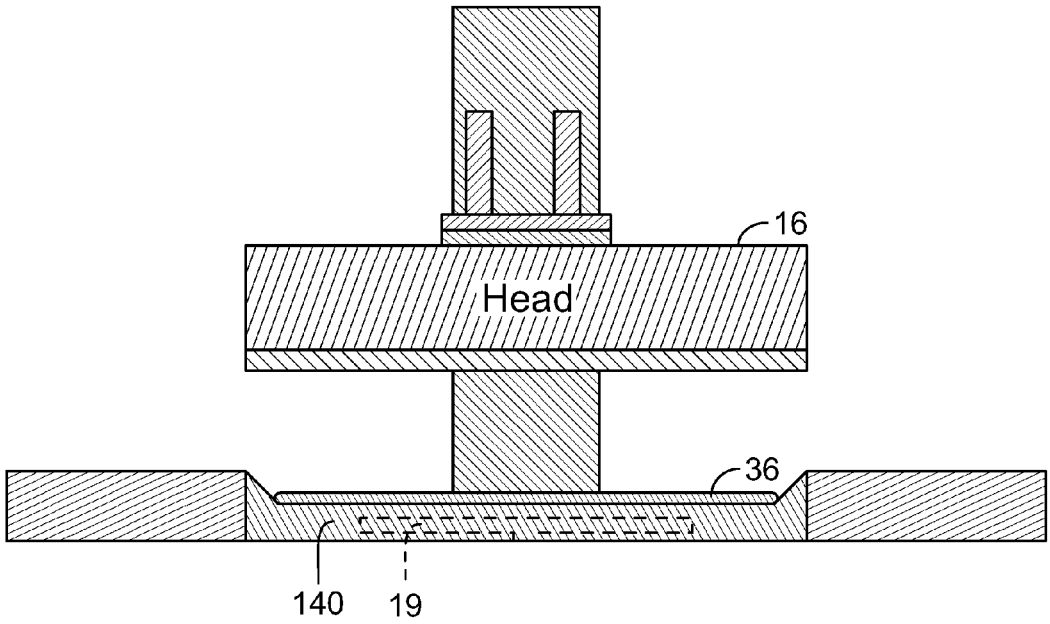

In the illustrated embodiment, downward vertical motion of the pedestal 19 terminates at the lower position below the wafer positioner 140 as depicted in FIG. 6*g*. The pedestal actuator 294 coupled to the pedestal connecting rod 292 vertically actuates the pedestal 19 from the raised position depicted in FIG. 6*f* and the lowered position depicted in FIG. 6*g*. It is appreciated that other terminal positions may be selected, depending upon the particular application.

An example of polishing head testing has been provided in which a test wafer is aligned by the wafer positioner 140 and lifted to the polishing head 16 in preparation for the polishing head 16 to load the test wafer. It is appreciated that some polishing head tests utilizing a test station in accordance with the present description may omit a test wafer loading operation, or a test wafer alignment operation, or a test wafer lifting operation, depending upon the particular application.

Figure 11:
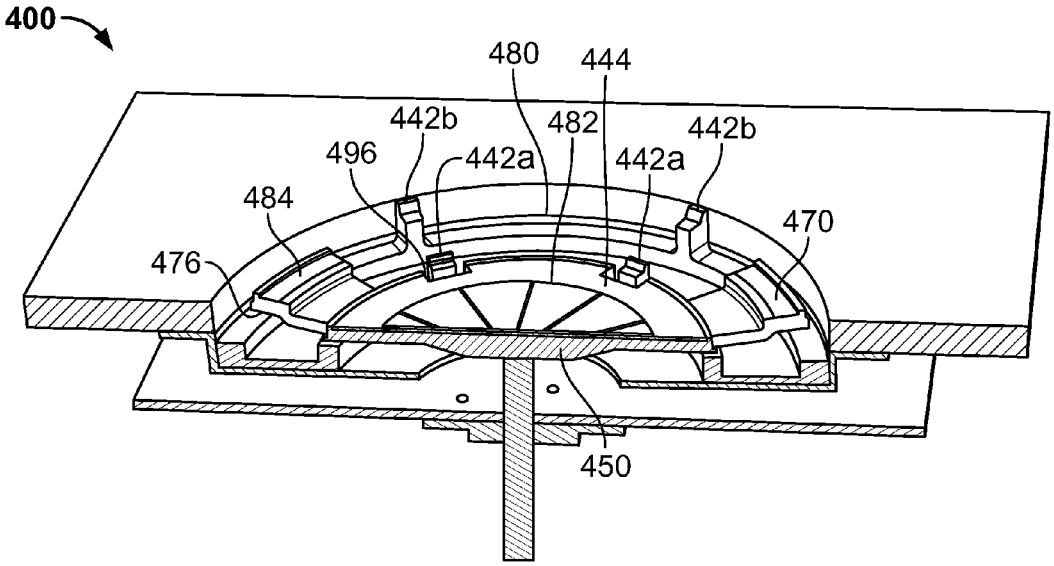
FIG. 11 is a schematic partial perspective cross-sectional view of a test wafer hold and transfer system in accordance with another embodiment.
Figure 12:
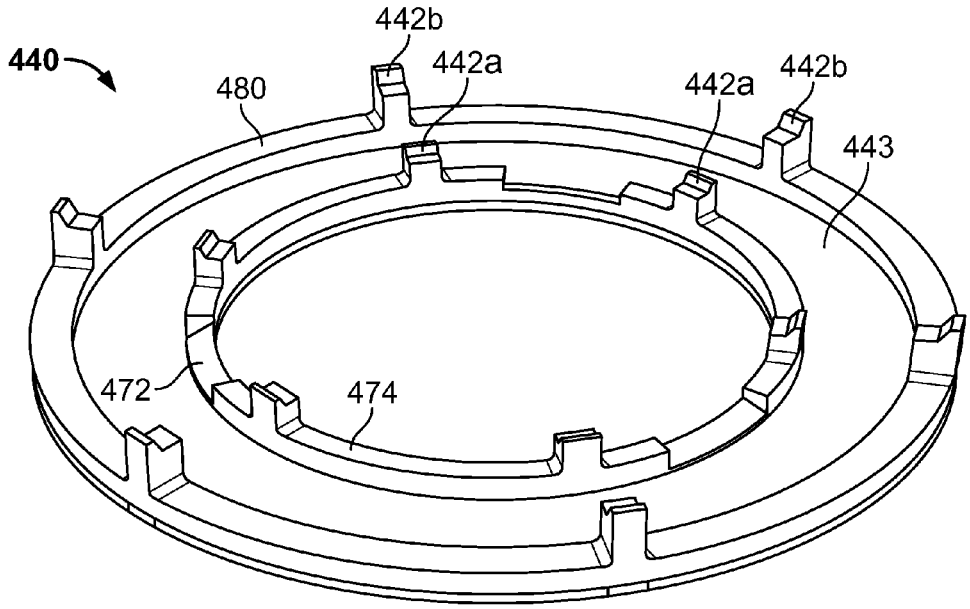
FIG. 12 is a perspective view of one example of a wafer positioner for the test wafer hold and transfer system of FIG. 11.

FIG. 11 shows another embodiment of a test wafer hold and transfer system 400 in accordance with another aspect of the present description. As best seen in FIG. 12, the test wafer hold and transfer system 400 includes a test wafer positioner 440 which has a first plurality of test wafer engagement members 442*a* carried by a 20 ring member 443 and distributed about the inner circumference of the ring member 443. The test wafer positioner 440 further has a second plurality of test wafer engagement members 442*b* carried by the ring member 443 and distributed about the outer circumference of the ring member 443.

Figure 13:
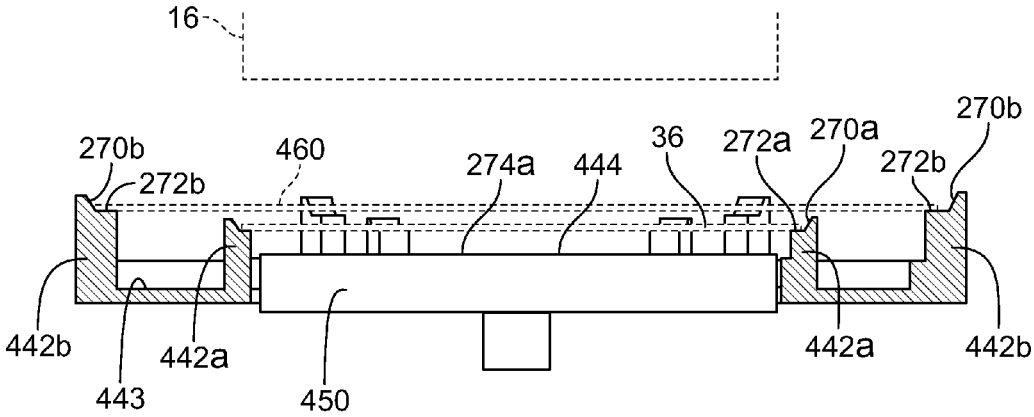
FIG. 13 is a schematic partial perspective cross-sectional view of the wafer positioner of FIG. 12, illustrating positioning of test wafers of differing sizes.

As best seen in FIG. 13, the test wafer engagement members 442*a* of the wafer positioner 440 are positioned around a central wafer support surface 444 of a pedestal 450. The test wafer engagement members 442*a* are adapted to engage and position a test wafer 36 with respect to the pedestal central wafer support surface 444 prior to the pedestal 450 receiving the test wafer 36 and transporting the test wafer 36 (FIG. 13) up to the polishing head 16.

In the illustrated embodiment, the test wafer engagement members 442*a*, like the members 142, are generally finger-shaped and each includes an angled ramp surface 270*a* (FIG. 13) which engages the edge of the test wafer 36 and directs the test wafer to settle under the influence of gravity in an aligned position between the ramp surfaces 270*a* and supported by a generally horizontal support surface 272*a* of each test wafer engagement member 442*a*. In this aligned position, the center 274*a* of the central wafer support surface 444 of the pedestal 450 is coaxially aligned with the center of the test wafer 36 and the center axis of the head 16.

The test wafer engagement members 442*b* of the wafer positioner 440 are similarly positioned around the central wafer support surface 444 of the pedestal 450, but at a wider circumference than the wafer engagement members 442*a*. The test wafer engagement members 442*b* are adapted to engage and position a test wafer 460 with respect to the pedestal central wafer support surface 444 prior to the pedestal 450 receiving the test wafer 460 and transporting the test wafer 460 up to a polishing head. As in apparent in FIG. 13, the test wafer 460 may have a wider diameter than the test wafer 36. Accordingly, the test wafer hold and transfer system 400 can readily accommodate polishing heads and test wafers of differing size, such as 150 mm, 200 mm and 300 mm, for example.

The test wafer engagement members 442*b*, like the members 442*a*, are generally finger-shaped and each includes an angled ramp surface 270*b* (FIG. 13) which engages the edge of the test wafer 460 and directs the test wafer to settle under the influence of gravity in an aligned position between the ramp surfaces 270*b* and supported by a generally horizontal support surface 272*b* of each test wafer engagement member 442*b*. In this aligned position, the center 274*a* of the central wafer support surface 444 of the pedestal 450 is coaxially aligned with the center of the test wafer 460 and the polishing head.

In the illustrated embodiment, the pedestal 450 includes a plurality of flanges 470 (FIG. 11) which are received in recesses 472 (FIG. 12) of an inner ring wall 474 of the ring member 443 of the wafer positioner 440. An outer shoulder 476 of each flange 470 engages an outer ring wall 480 of the ring member 443. The central wafer support surface 444 may have cushions 482 to inhibit damage to the test wafers.

Figure 14:
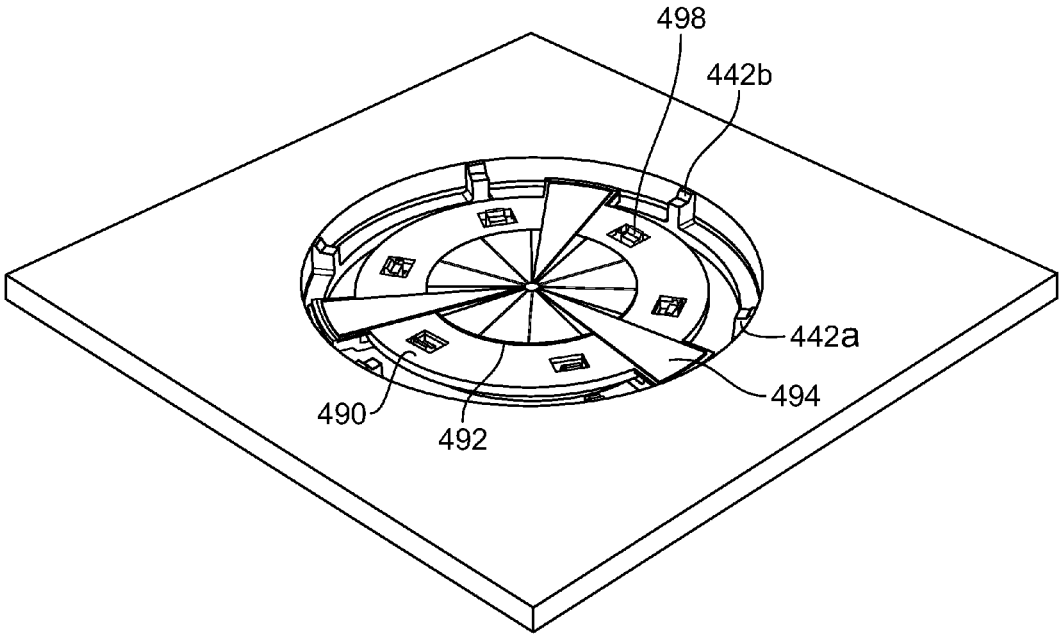
FIG. 14 is a top perspective view of a test wafer hold and transfer system having a pedestal in accordance with yet another embodiment.

In one embodiment, a pedestal such as the pedestal 450 may be dedicated to test wafers of a particular size such as the test wafers 36 or the test wafers 460. Alternatively, the pedestal 450 may be able to accommodate test wafers of different sizes. For example, an upper surface 484 of the pedestal flanges 470 may be adapted to provide a pedestal outer wafer support surface to engage and support a larger test wafer such as a test wafer 460. In another example, the test wafer hold and transfer system 400 may include a pedestal adapter plate 490 (FIG. 14) having both a pedestal central wafer support surface 492 and a pedestal outer wafer support surface 494. The pedestal adapter plate 490 may be carried by the pedestal flanges 470 and may be dedicated to larger test wafers such as test wafer 460 or alternatively may be adapted to accommodate test wafers of different sizes. In the illustrated embodiment, the pedestal adapter plate 490 carries test wafer cushions on both the pedestal central wafer support surface 492 and the pedestal outer wafer support surface 494.

As shown in FIG. 11, the central wafer support surface 444 of the pedestal 450 defines a plurality of recesses 496 wherein each aperture is adapted to receive a test wafer engagement member 442*a* when the pedestal central wafer support surface 444 is in a lowered vertical position. Similarly, the central wafer support surface 492 of the pedestal adapter plate 490 defines a plurality of recesses 498 (FIG. 14) aligned with the recesses 496 and adapted to receive a test wafer engagement member 442*a* when the pedestal adapter plate is in a lowered vertical position. Because the wafer engagement surfaces 470*b*, 472*b* of the test wafer engagement members 442*b* are positioned vertically closer to the polishing head 16 than the corresponding wafer engagement surfaces 470*a*, 472*a* of the test wafer engagement members 442*a*, a larger diameter test wafer such as the test wafer 460 may be aligned and supported by the test wafer engagement members 442*b* above the tops of the test wafer engagement members 442*a* as shown in FIG. 22. Thus, the test wafer engagement members 442*b* can be used with the larger test wafer 460 without the test wafer engagement members 442*a* for the smaller test wafer interfering with a larger test wafer.

Referring again to FIG. 1, the platform 12 has a set of wheels or rollers 600 which permit the test station to be readily rolled from one site to another within the fabrication facility for testing polishing heads. This can be particularly useful where the facility has more several polishing systems which utilize different sized heads.

As described in greater detail in U.S. Pat. No. 7,089,782, the test station 10 may include a lateral carriage assembly to facilitate loading and mounting a polishing head 16 into the test station for testing. It is appreciated that the details and 30 particulars of such a lateral carriage assembly may vary, depending upon the particular application. Still further, the test station 10 may include a wafer chuck to chuck a test wafer in place for testing the polishing head. Again, the details of such a wafer chuck will depend upon the particular application.

It will, of course, be understood that modifications of the illustrated embodiments, in their various aspects, will be apparent to those skilled in the art, some being apparent only after study, others being matters of routine mechanical and electronic design. Other embodiments are also possible, their specific designs depending upon the particular application. As such, the scope of this description should not be limited by the particular embodiments described herein but should be defined by the appended claims and equivalents thereof.

What is claimed is:

1. A test station for testing a polishing head using a test wafer, the polishing head for planarizing a semiconductor wafer, the station comprising:

a frame;

a pedestal having a central wafer support surface adapted to support a test wafer;

a test wafer positioner having a first plurality of test wafer engagement members positioned around said central wafer support surface;

a polishing head mount adapted to mount said polishing head over said central wafer support surface;

a pneumatic circuit adapted to couple to said polishing head and to pressure test said polishing head;

a head mount actuator, coupled to said frame and said polishing head mount and adapted to move said polishing head in a vertical direction relative to said central wafer support surface; and a pedestal actuator, coupled to said frame and said pedestal and adapted to move said central wafer support surface in a vertical direction relative to said frame between a first vertical position vertically displaced from said polishing head of said polishing head mount, and a second vertical position vertically closer to said polishing head of said polishing head mount as compared to the first vertical position, wherein the first plurality of test wafer engagement members each includes a respective wafer engagement surface adapted to engage and position said test wafer with respect to said central wafer support surface when the central wafer support surface is at the first vertical location, and wherein the central wafer support surface is below the respective wafer engagement surfaces of the first plurality of test wafer engagement members when the central wafer support surface is at the first vertical position, and is configured to lift said test wafer off and away from the respective wafer engagement surfaces of the first plurality of test wafer engagement members when the central wafer support surface is moved from the first vertical position to the second vertical position.

2. The test station of claim 1, wherein said wafer positioner comprises a ring member adapted to carry said first plurality of test wafer engagement members distributed about a first circumference of said ring member.

3. The test station of claim 2 wherein said central wafer support surface of the pedestal defines a plurality of apertures, each aperture adapted to receive a test wafer engagement member of said first plurality of test wafer engagement members when said pedestal central wafer support surface is in said first vertical position.

4. The test station of claim 2 wherein said pedestal has an outer wafer support surface disposed around said central wafer support surface and adapted to support a test wafer; and wherein said positioner comprises a second plurality of test wafer engagement members carried by said ring and positioned around said outer wafer support surface and distributed about a second circumference of said ring member, said second circumference having a wider diameter than said first circumference.

5. The test station of claim 4 wherein each test wafer engagement member of said second pluralities of test wafer engagement members has a test wafer engagement surface and where each test wafer engagement surface of said second plurality of test wafer engagement members is vertically displaced closer to said polishing head than the test wafer engagement surfaces of said first plurality of test wafer engagement members.

6. The test station of claim 1, wherein said frame includes a support plate having a top surface which defines a cavity adapted to receive said pedestal and said test wafer positioner below said top surface, said frame further comprising a removable cover plate adapted to be disposed on said top surface and cover said pedestal and test wafer positioner, said cover plate having a test wafer support surface.

7. A method of testing a polishing head for planarizing a semiconductor wafer, comprising:

mounting a polishing head to a polishing head mount of a test station;

controlling a controllable head mount actuator to move said polishing head in a vertical direction relative to a central wafer support surface of a pedestal;

positioning a test wafer using a wafer positioner having a first plurality of test wafer engagement members positioned around the central wafer support surface of the pedestal, said positioning including engaging said test wafer with a respective engagement surface of each of said first plurality of test wafer engagement members and positioning said test wafer with respect to said central wafer support surface of the pedestal;

controlling a controllable pedestal actuator to move said central wafer support surface in a vertical direction relative to said polishing head between a first vertical position vertically displaced from said polishing head, and a second vertical position vertically closer to said polishing head, wherein the central wafer support surface is below the respective engagement surfaces of said first plurality of test wafer engagement members when the central wafer support surface is at the first vertical position, and wherein during movement of the pedestal central wafer support surface from the first vertical position to the second vertical position, the pedestal central wafer support surface lifts said test wafer off and away from the respective engagement surfaces of said first plurality of test wafer engagement members;

and testing said polishing head.

8. The method of claim 7 wherein said testing includes testing a wafer loss sensor of the polishing head.

9. The method of claim 8 wherein said testing includes applying vacuum pressure to a membrane chamber of said polishing head to pick up a first test wafer disposed on said central wafer support surface.

10. The method of claim 9 wherein said testing includes applying pressure to an inner tube chamber of said polishing head prior to applying said vacuum pressure to said membrane chamber.

11. The method of claim 10 wherein said testing includes monitoring the pressure in said inner tube chamber while applying said vacuum pressure to said membrane chamber.

12. The method of claim 7, wherein said wafer positioner comprises a ring member adapted to carry said first plurality of test wafer engagement members distributed about a first circumference of said ring member.

13. The method of claim 12 wherein said pedestal defines a plurality of apertures, and wherein said controlling a controllable pedestal actuator includes moving said pedestal so that each test wafer engagement member is received by an aperture of said plurality of apertures when said central wafer support surface is in said first vertical position.

14. The method of claim 12, wherein the wafer positioner further includes a second plurality of test wafer engagement members positioned around an outer wafer support surface disposed around said central wafer support surface and adapted to support a test wafer, wherein said second plurality of test wafer engagement members is distributed about a second circumference of said ring member, said second circumference having a wider diameter than said first circumference, and wherein the method further comprises positioning a test wafer having a second diameter wider than said first diameter using the second plurality of test wafer engagement members of the wafer positioner.

15. The method of claim 7, wherein said frame includes a support plate having a top surface which defines a cavity adapted to receive said pedestal and said test wafer positioner below said top surface, said frame further comprising a removable cover plate adapted to be disposed on said top surface and cover said pedestal and test wafer positioner, said cover plate having a test wafer support surface, and wherein the method further comprises removing the cover plate to expose said pedestal and test wafer positioner.

* * * * *